US008474144B2

(12) United States Patent
Royle

(10) Patent No.: US 8,474,144 B2
(45) **Date of Patent: *Jul. 2, 2013**

(54) SAFETY RAZOR WITH ROTATIONAL MOVEMENT AND LOCKING BUTTON

(75) Inventor: Terence Gordon Royle, Basingstoke (GB)

(73) Assignee: The Gillette Company, Boston, MA (US)

( * ) Notice: Subject to any disclaimer, the term of this patent is extended or adjusted under 35 U.S.C. 154(b) by 353 days.

This patent is subject to a terminal disclaimer.

(21) Appl. No.: 12/752,200

(22) Filed: Apr. 1, 2010

(65) Prior Publication Data

US 2011/0035950 A1 Feb. 17, 2011

Related U.S. Application Data

(60) Provisional application No. 61/233,159, filed on Aug. 12, 2009.

(51) Int. Cl.
*B26B 21/52* (2006.01)

(52) U.S. Cl.
USPC ..... 30/532; 30/527

(58) Field of Classification Search
USPC ..... 30/32, 33, 37, 58, 61, 67, 66, 87, 30/526, 527, 528, 529, 47, 51, 57, 530–533
See application file for complete search history.

(56) References Cited

U.S. PATENT DOCUMENTS

| | | | | |
|---|---|---|---|---|
| 2,211,255 | A * | 8/1940 | Claassen | 30/532 |
| 3,950,848 | A | 4/1976 | Goldstein | |
| 3,964,160 | A | 6/1976 | Gordon | |
| 4,083,103 | A * | 4/1978 | Estandian | 30/47 |
| 4,275,498 | A | 6/1981 | Ciaffone | |
| 4,347,663 | A * | 9/1982 | Ullmo | 30/47 |
| 4,475,286 | A * | 10/1984 | Saito | 30/527 |
| 4,573,266 | A * | 3/1986 | Jacobson | 30/41 |
| 4,797,998 | A | 1/1989 | Motta | |
| 4,922,609 | A * | 5/1990 | Grange | 30/57 |

(Continued)

FOREIGN PATENT DOCUMENTS

| | | | |
|---|---|---|---|
| DE | 202006011254 | U1 | 1/2007 |
| WO | WO-2011/094887 | A1 | 8/2011 |

(Continued)

OTHER PUBLICATIONS

PCT International Search Report with Written Opinion in corresponding Int'l appln. PCT/US2010/044519 dated Oct. 20, 2010.

*Primary Examiner* — Kenneth E. Peterson

*Assistant Examiner* — Fernando Ayala

(74) *Attorney, Agent, or Firm* — Joanne N. Pappas; Kevin C. Johnson; Steven W. Miller

(57) ABSTRACT

A safety razor including a handle having a grip portion and a connection portion secured to the grip portion. The connection portion rotates with respect to the grip portion about a rotational axis. A blade unit is mounted to the connection portion by a connection member. The handle includes an ejector button having a first position locking the connection portion with respect to the grip portion preventing the connection portion from rotating with respect to the grip portion, a second position allowing the connection portion to rotate with respect to the grip portion, and a third position for ejecting the blade unit from the connection portion.

17 Claims, 9 Drawing Sheets

U.S. PATENT DOCUMENTS

| | | | | |
|---|---|---|---|---|
| 4,926,553 | A * | 5/1990 | Miskin et al. | 30/49 |
| 5,029,391 | A | 7/1991 | Althaus et al. | |
| 5,033,152 | A * | 7/1991 | Althaus | 30/527 |
| 5,093,991 | A | 3/1992 | Hendrickson | |
| 5,526,568 | A | 6/1996 | Copelan | |
| 5,535,518 | A | 7/1996 | Althaus | |
| 5,560,106 | A * | 10/1996 | Armbruster et al. | 30/527 |
| 5,787,593 | A | 8/1998 | Althaus | |
| 5,953,824 | A * | 9/1999 | Ferraro et al. | 30/527 |
| 6,115,924 | A | 9/2000 | Oldroyd | |
| 6,138,361 | A * | 10/2000 | Richard et al. | 30/50 |
| 6,311,400 | B1 | 11/2001 | Hawes et al. | |
| 6,381,857 | B1 | 5/2002 | Oldroyd | |
| 6,615,498 | B1 * | 9/2003 | King et al. | 30/527 |
| 6,880,253 | B1 * | 4/2005 | Gyllerstrom | 30/527 |
| 7,137,205 | B2 | 11/2006 | Royle | |
| 7,140,116 | B2 * | 11/2006 | Coffin | 30/531 |
| 7,685,720 | B2 * | 3/2010 | Efthimiadis et al. | 30/527 |
| 7,877,879 | B2 | 2/2011 | Nakasuka | |
| 7,895,754 | B2 | 3/2011 | Blackburn | |
| 7,913,393 | B2 | 3/2011 | Royle et al. | |
| 7,937,837 | B2 | 5/2011 | Psimadas et al. | |
| 7,971,363 | B2 | 7/2011 | Nakasuka | |
| 8,024,863 | B2 | 9/2011 | Wain | |
| 8,033,022 | B2 | 10/2011 | Ben-Ari | |
| 8,033,023 | B2 | 10/2011 | Johnson et al. | |
| 8,061,041 | B2 | 11/2011 | Jessemey et al. | |
| 8,065,802 | B2 | 11/2011 | Oglesby et al. | |
| 8,079,147 | B2 | 12/2011 | Wonderley | |
| 8,151,466 | B2 | 4/2012 | Putzer | |
| 8,151,472 | B2 | 4/2012 | Dimitris et al. | |
| 8,166,658 | B2 | 5/2012 | Nakasuka | |
| 8,166,661 | B2 | 5/2012 | King | |
| 8,205,343 | B2 | 6/2012 | Winter et al. | |
| 8,205,344 | B2 | 6/2012 | Stevens | |
| 8,234,789 | B2 | 8/2012 | Avens et al. | |
| 8,261,451 | B2 | 9/2012 | Macove | |
| 8,286,354 | B2 | 10/2012 | Walker, Jr. et al. | |
| 8,323,562 | B2 | 12/2012 | Schorr et al. | |
| 2002/0026721 | A1 * | 3/2002 | Lee et al. | 30/532 |
| 2003/0061718 | A1 * | 4/2003 | Dansreau | 30/532 |
| 2004/0177519 | A1 * | 9/2004 | Tomassetti et al. | 30/527 |
| 2009/0313837 | A1 * | 12/2009 | Winter et al. | 30/527 |
| 2010/0043242 | A1 * | 2/2010 | Stevens | 30/527 |
| 2010/0132204 | A1 | 6/2010 | Brown | |
| 2010/0154221 | A1 | 6/2010 | De Benedetto et al. | |
| 2010/0313426 | A1 * | 12/2010 | Royle | 30/57 |
| 2011/0010943 | A1 | 1/2011 | Izumi | |
| 2011/0023305 | A1 | 2/2011 | Whelan et al. | |
| 2011/0035950 | A1 | 2/2011 | Royle | |
| 2011/0067245 | A1 | 3/2011 | Bridges et al. | |
| 2011/0088268 | A1 | 4/2011 | Marut | |
| 2011/0138637 | A1 | 6/2011 | Bucco | |
| 2011/0146080 | A1 | 6/2011 | Pauw | |
| 2011/0167641 | A1 | 7/2011 | Brada et al. | |
| 2011/0167653 | A1 | 7/2011 | Psimadas et al. | |
| 2011/0173821 | A1 | 7/2011 | Hage et al. | |
| 2011/0225826 | A1 | 9/2011 | Leventhal | |
| 2011/0239475 | A1 | 10/2011 | Efthimiadis et al. | |
| 2011/0247217 | A1 | 10/2011 | Johnson et al. | |
| 2011/0277326 | A1 | 11/2011 | Bodet | |
| 2011/0308089 | A1 | 12/2011 | Bridges | |
| 2012/0047754 | A1 | 3/2012 | Schmitt | |
| 2012/0060382 | A1 | 3/2012 | Beugels et al. | |
| 2012/0073149 | A1 | 3/2012 | Murgida et al. | |
| 2012/0073150 | A1 | 3/2012 | Murgida et al. | |
| 2012/0084984 | A1 | 4/2012 | Davis | |
| 2012/0096718 | A1 | 4/2012 | Howell et al. | |
| 2012/0096722 | A1 | 4/2012 | Howell et al. | |
| 2012/0096723 | A1 | 4/2012 | Howell et al. | |
| 2012/0124840 | A1 | 5/2012 | Iaccarino et al. | |
| 2012/0198698 | A1 | 8/2012 | Szczepanowski et al. | |
| 2012/0233868 | A1 | 9/2012 | Bridges et al. | |
| 2012/0255185 | A1 | 10/2012 | Patel et al. | |
| 2012/0260509 | A1 | 10/2012 | Fang et al. | |
| 2012/0291295 | A1 | 11/2012 | Braun | |
| 2012/0297625 | A1 | 11/2012 | Madden | |

FOREIGN PATENT DOCUMENTS

| | | | |
|---|---|---|---|
| WO | WO-2012/157624 | A1 | 11/2012 |
| WO | WO-2012/158143 | A1 | 11/2012 |
| WO | WO-2012/161449 | A2 | 11/2012 |

* cited by examiner

SAFETY RAZOR WITH ROTATIONAL MOVEMENT AND LOCKING BUTTON

CROSS REFERENCE TO RELATED APPLICATIONS

The application claims the benefit of U.S. Provisional Application No. 61/233,159, filed Aug. 12, 2009.

FIELD OF THE INVENTION

The present invention relates to safety razors including a handle having a grip portion and a connection portion with a blade unit mounted to the connection portion by a connection member. More particularly, the present invention relates to safety razors including a handle having a grip portion and a connection portion secured to the grip portion where the connection portion rotates with respect to the grip portion about a rotational axis. The handle includes an ejector button having a first position locking the connection portion with respect to the grip portion preventing the connection portion from rotating with respect to the grip portion, a second position allowing the connection portion to rotate with respect to the grip portion and a third position for ejecting the blade unit from the connection portion.

BACKGROUND OF THE INVENTION

Safety razors today have a blade unit connected to a handle for a pivotal movement about a single pivotal axis which is substantially parallel to the blade (i.e., the blade edge). The pivotal movement about the single axis provides some degree of conformance with the skin allowing the blade unit to easily follow the skin contours of a user during shaving. The pivot axis, which usually extends parallel to the cutting edges of the blades, can be defined by a pivot structure where the handle is connected to the blade unit. Such safety razors have been successfully marketed for many years. However, the blade unit often disengages from the skin during shaving as it has limited mobility able to pivot about only a single axis.

To address this problem, it has been suggested that the safety razors be provided with blade units that can additionally pivot about another axis which is substantially perpendicular to the blade(s). Such safety razors do provide improved conformance of the blade unit to the contours of the face during shaving.

While these safety razors which provide a blade unit that pivots about two axes help the blade unit to more suitably follow the contours of the face during shaving, they do not follow all the contours of the body during shaving.

It has been found that by providing a safety razor having both pivotal and rotational movement the blade unit can closely follow all the contours of the body during shaving.

Thus, there is a need for a safety razor having a blade unit capable of a pivotal movement about a pivot axis and rotational movement about a rotational axis to provide a safety razor which can closely follow all the contours of the body during shaving.

There is also a need for a safety razor capable of providing rotational movement about a rotation axis with an ejector button having a first position locking the connection portion with respect to the grip portion preventing the connection portion from rotating with respect to the grip portion, a second position allowing the connection portion to rotate with respect to the grip portion, and a third position for ejecting the blade unit from the connection portion.

SUMMARY OF THE INVENTION

Provided in accordance with the present invention is a safety razor comprising a handle, the handle comprising a grip portion and a connection portion secured to the grip portion, the connection portion rotating with respect to the grip portion about a rotational axis; a blade unit is mounted to the connection portion by a connection member; and an ejector button having a first position locking the connection portion with respect to the grip portion preventing the connection portion from rotating with respect to the grip portion, a second position allowing the connection portion to rotate with respect to the grip portion and a third position for ejecting the blade unit from the connection portion.

The blade unit may comprise a guard, a cap, at least one blade positioned between the guard and the cap and a transverse centerline extending through the guard and the cap in a direction substantially perpendicular to the at least one blade, the blade unit pivoting with respect to the connection member about a pivot axis substantially parallel to the at least one blade.

The rotational axis may intersect the transverse centerline. The grip portion of the handle may comprise a bore and the connection portion may comprise a rod wherein the bore of the grip portion receives the rod of the connection portion. The rod may comprise a pin extending radially outward from the rod.

The razor may comprise a return force generating member connecting the pin with the grip portion. The return force generating member may comprise an elastomeric member.

The grip portion may comprise a longitudinal centerline and the bore is positioned at an angle with respect to the grip portion longitudinal centerline.

The blade unit may be releasably mounted to the connection portion by the connection member.

BRIEF DESCRIPTION OF THE DRAWINGS

While the specification concludes with claims particularly pointing out and distinctly claiming the subject matter which is regarded as forming the present invention, it is believed that the invention will be better understood from the following description taken in conjunction with the accompanying drawings.

DETAILED DESCRIPTION OF THE INVENTION

Figure 1:
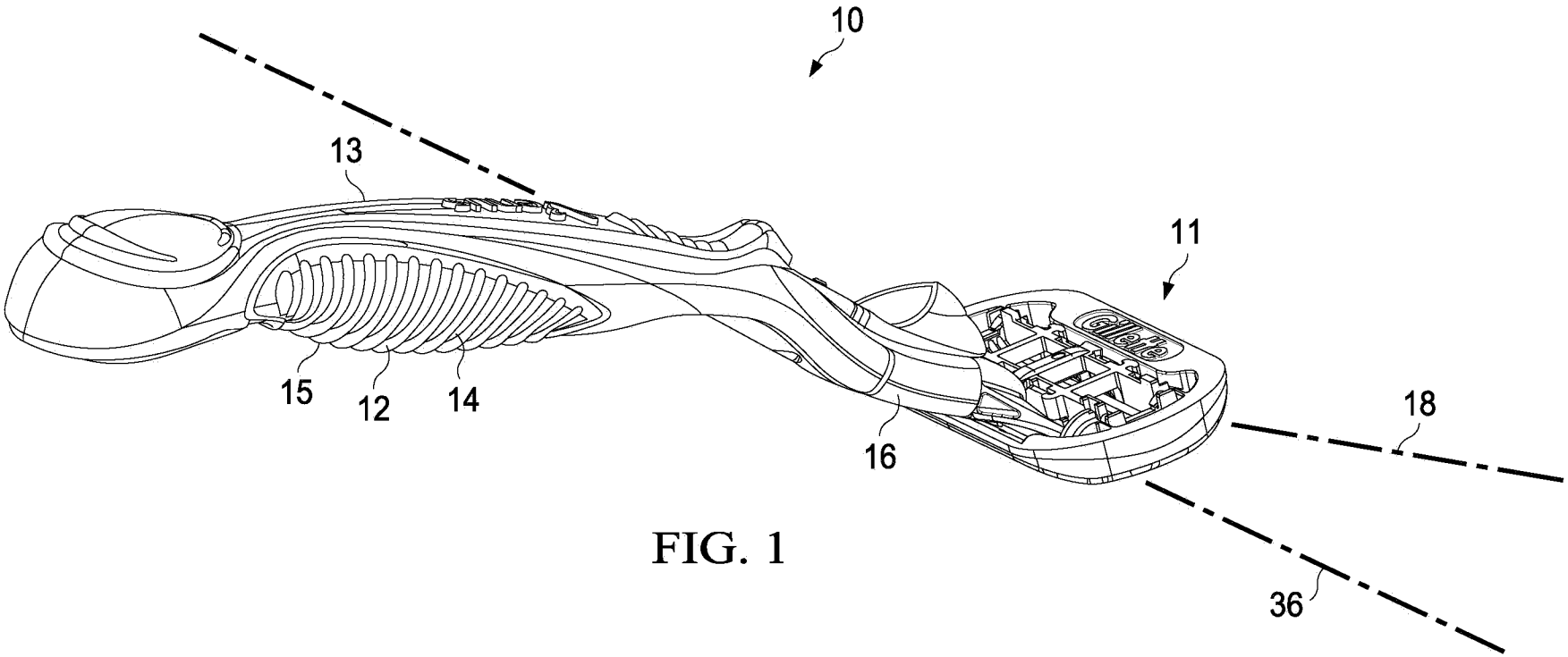
FIG. 1 is a rear, side perspective view of a safety razor in accordance with the present invention.
Figure 2:
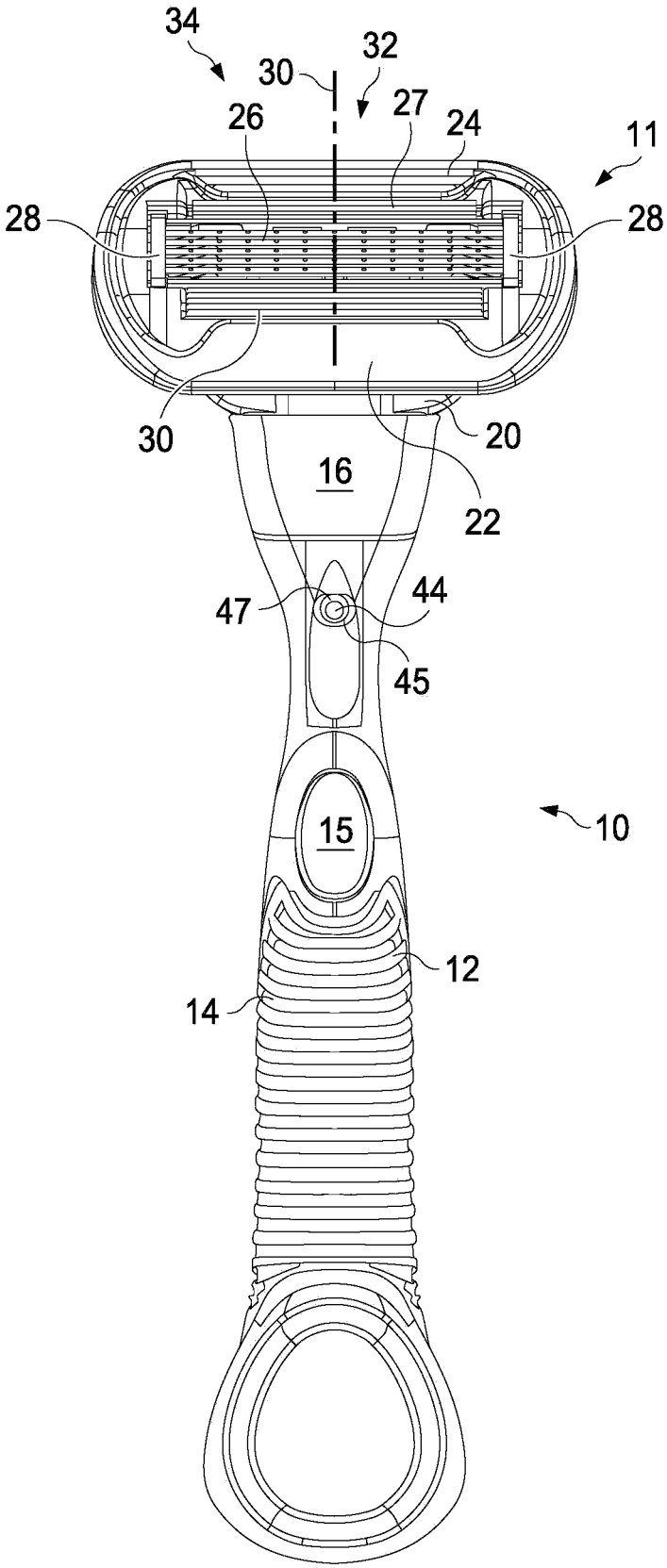
FIG. 2 is a front plan view of the safety razor shown in FIG. 1.

Referring to FIGS. 1 and 2, safety razor 10 comprises a blade unit 11 mounted on a handle 12. The handle 12 comprises a grip portion 14 and a connection portion 16 secured to the grip portion 14. Handle 12 includes a bottom surface 15 and a top surface 13. The connection portion 16 rotates with respect to the grip portion 14 about a rotational axis 18. The blade unit 11 is mounted to the connection portion 16 by a connection member 20. As shown the blade unit 11 is releasably mounted to the connection portion 16 by the connection member 20. The blade unit 11 may be fixedly mounted to the connection portion 16 by the connection member 20 (not shown) to provide a disposable safety razor.

Blade unit 11 comprises a guard 22 at the front of the blade unit 11, a cap 24 at the rear of the blade unit 11 and at least one elongated blade 26 positioned between the guard 22 and the cap 24. Although five blades 26 are shown it is understood that more or less blades 26 may be mounted within the blade unit 11. The blades 26 are shown secured within the blade unit 11 with clips 28, but other assembly method known to those skilled in the art may also be used. The guard 22 may have a plurality of fins 30 spaced apart from each other that extend longitudinally along a length of the blade unit 11. The cap 24 may have a lubricating strip 27.

The blade unit 11 has a transverse centerline 30 extending through the guard 22 and the cap 24 in a direction substantially perpendicular to the at least one blade 26. The transverse centerline 30 divides the blade unit 11 into substantially equal right half 32 and left half 34. The blade unit 11 pivots with respect to the connection member 16 about a pivot axis 36 that extends substantially parallel to the at least one blade 26.

The pivot axis 36 is preferably in front of the blades 26 and below a plane tangential to the guard 22 and cap 24, although other pivot positions are possible. The blade unit 11 may have a pivot range up to about 45° about pivot axis 36. Other pivot ranges both larger and smaller may be used if desired.

The rotational axis 18 preferably intersects the transverse centerline 30. This intersection aligns the blade unit 11 with the handle 12 to provide a balanced safety razor 10. The intersection allows the right half 32 and left half 34 to rotate equally from one side to the other about handle 12. The connection portion 16 and accordingly the blade unit 11 may have a rotation range up to about 30° about rotational axis 18, e.g., about 15° in one direction and about 15° in the opposite direction.

The rotational axis 18 and the pivot axis 36 may intersect one another. Alternatively, the rotational axis 18 may be spaced from the pivot axis 36, at their closest measured distance, by a distance of less about 10 mm, preferably less than about 5 mm. The closer the rotational axis 18 is to the pivot axis 36 the user has more control over the movement of the blade unit 11 during shaving.

Figure 3:
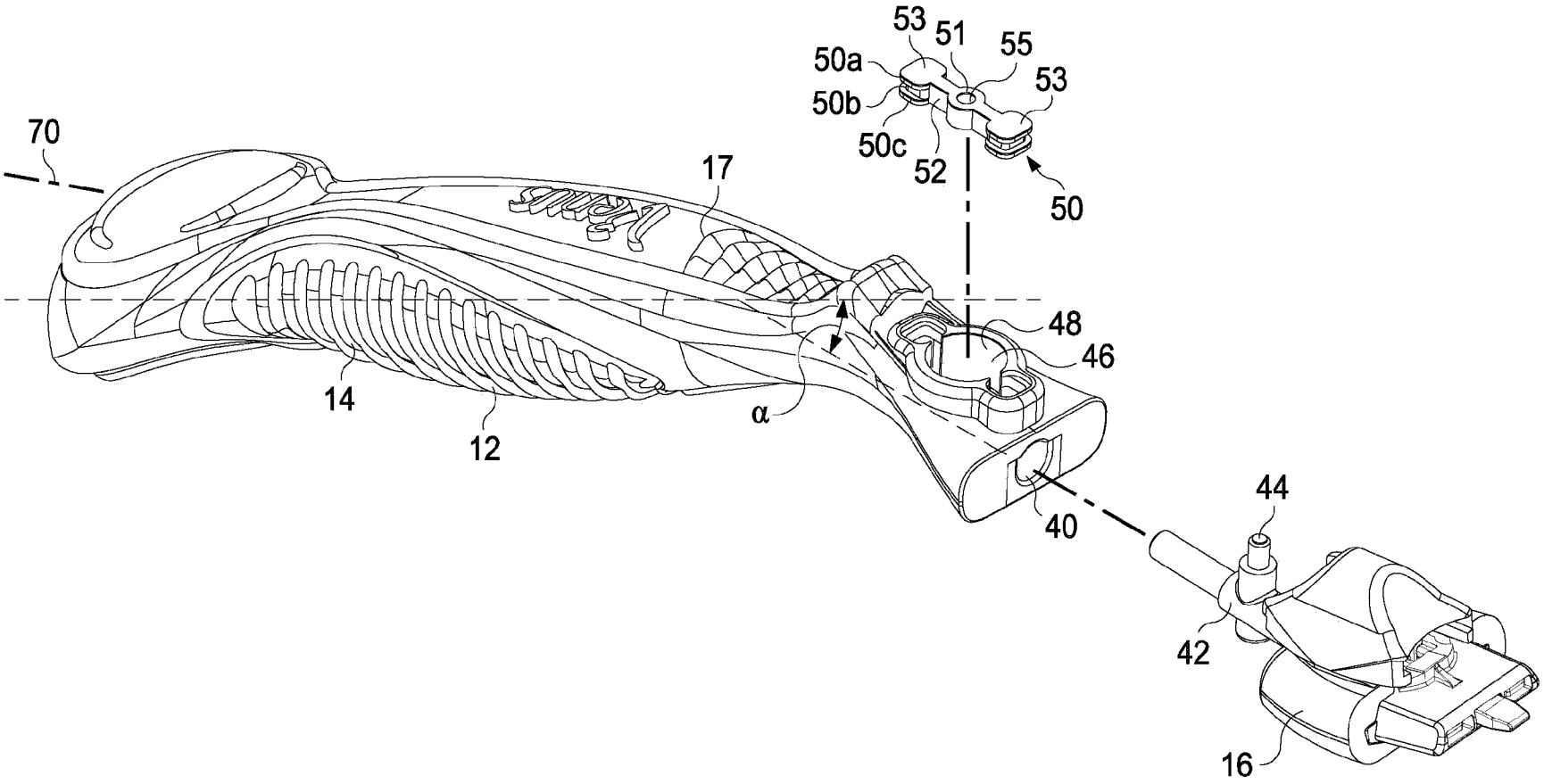
FIG. 3 is an exploded perspective view of the handle of the safety razor shown in FIG. 1.
Figure 4:
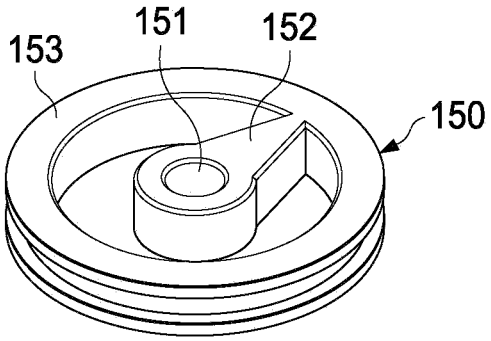
FIGS. 4-11 are perspective views of alternative return force generating members of the present invention.
Figure 5:
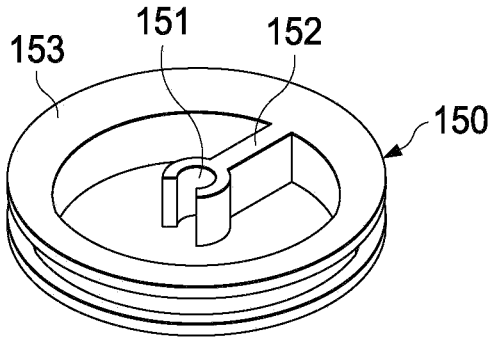
Figure 6:
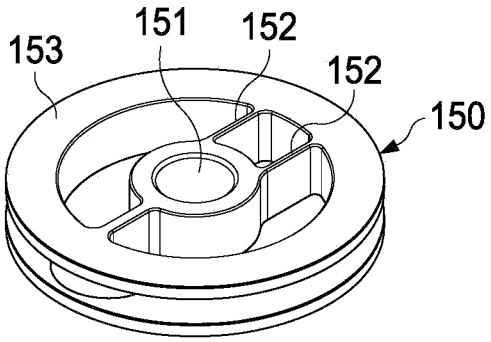
Figure 7:
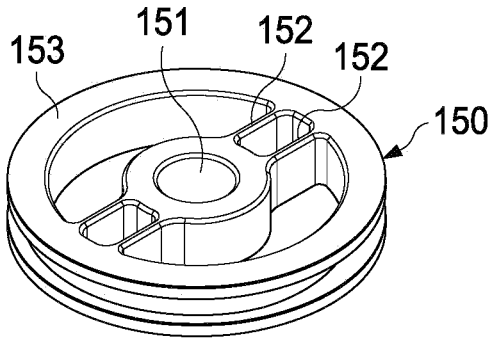
Figure 8:
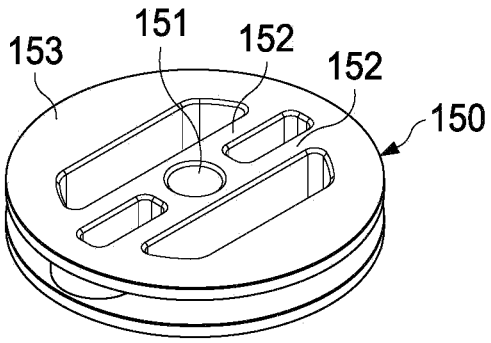
Figure 9:
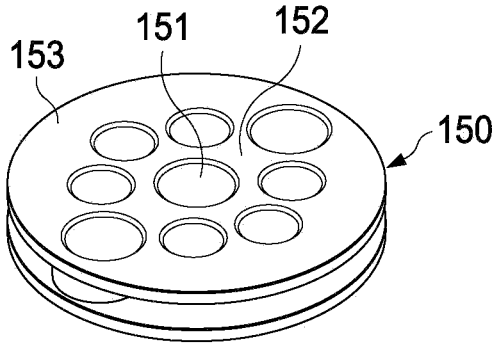
Figure 10:
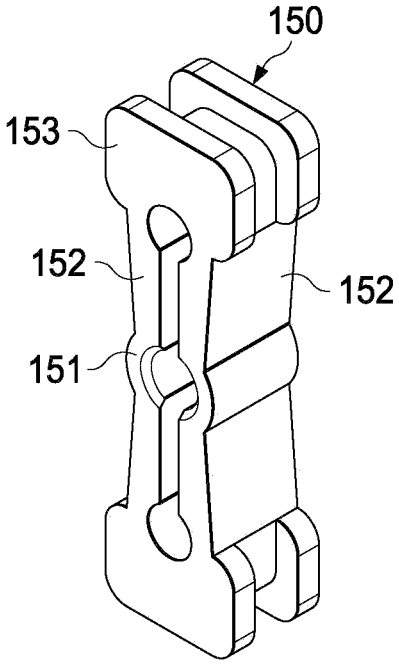
Figure 11:
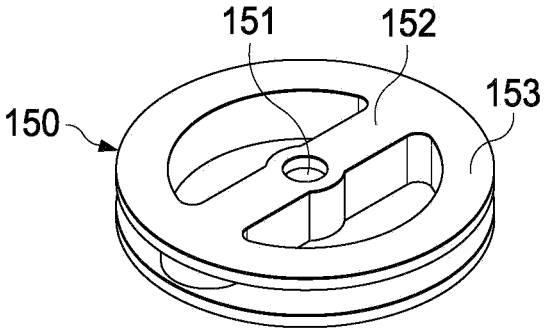

Referring now to FIG. 3, the grip portion 14 comprises a bore 40 and the connection portion 16 comprises a rod 42. The bore 40 of the grip portion 14 is sized and shaped to receive the rod 42 of the connection portion 16 in a manner to allow rod 42 to rotate within bore 40. The rod 42 comprises a pin 44 extending radially outward from rod 42. Pin 44 is inserted within opening 46 in grip portion 14 into rod 42.

Referring now to FIG. 2, pin 44 secures connection portion 16 with grip portion 14 preventing connection portion 16 from disengaging from grip portion 14 as pin 44 engages the side wall 47 of opening 45 in bottom surface 11 if the connection portion 16 is pulled from grip portion 14. The side to side movement of pin 44 is limited by the size of opening 45.

Referring now to FIG. 3, a return force generating member 50 connects the pin 44 with the grip portion 14. The return force generating member 50 generates a return force for the connection portion 16 in response to the relative rotational movement of the blade unit (not shown) and in turn the connection portion 16. The return force generating member 50 may comprise an elongated member having a holding structure 51 for holding the pin 44 and elastic members 52 connected to the holding structure 51 for generating the return force in response to the relative movement of the connection portion 16. The return force generating member 50 may include outer supports 53 which support the elastic member 52. Outer supports 53 are sized and shaped to engage with side wall 48 of opening 46 in grip portion 14 to secure force generating member 50 and in turn connection portion 16 to grip portion 14.

Opening 46 in top surface 13 is larger than opening 47 in bottom surface 11 (shown in FIG. 2). This is necessary to accommodate force generating member 50 and its' relative movements as pin 44 moves from side to side within opening 46 as connection portion 16 rotates.

Opening 46 can take on any shape to hold or house the return force generating member 50. Since the return force generating member 50 is held in the opening 46 which is formed on the surface of grip portion 14, the safety razor can be produced by a simplified manufacturing process.

The holding structure 51 of the return force generating member 50 can take any shape or structure which can receive the relative movement transmitted from the connection portion 16. As shown in FIG. 3, the holding structure 51 has a round hole 55 which is formed at the center of the return force generating member 50 and has dimensions suitable for holding the pin 44. The shape of the hole 55 can vary depending on the shape or structure of the pin 44, for example, it can be circular, polygonal, or other shapes.

The elastic members 52 of the return force generating member 50 are formed of an elastomeric material. Such an elastomeric material may include synthetic or natural rubber materials. One example of such an elastomeric material is a polyether-based thermoplastic elastomer (TPE) which is available from Kriburg HTP under Code No. 1028/55. Another example of such an elastomeric material for use herein is a polyether-based thermoplastic vulcanized elastomer (TPV' s) which is available from Exxon Mobil Corporation under Code No. Santoprene™ 101-55/201-55.

The return force generating member 50 may be formed of a single material. Specifically, all the component members of the return force generating member 50 (i.e., holding structure 51, elastic members 52 and outer supports 53) are formed by an identical material.

The return force generating member 50 may be a layered structure formed by two or more different elastomeric materials. Herein, "different elastomeric materials" refers to two or more materials which have different elastic characteristics (e.g., elasticity). The different elastomeric materials do not have to be formed by two or materials but may be formed by an identical elastomeric material by selecting different physical parameters on each layer (e.g., thickness, density, etc.).

As shown in FIG. 3, for example, the return force generating member 50 includes a layered structure formed by three layers 50*a*, 50*b*, and 50*c* wherein the top and bottom layers 50*a* and 50*c* are formed from an identical elastomeric material while the middle layer 50*b* is formed from a different elastomeric material. In such a layered structure, the elastic characteristics of the return force generating member 50 can be controlled by controlling the thickness of each layer 50*a*, 50*b*, 50*c*, and or selecting the ingredient materials to be used in each layer.

The stepped features of return force generating member 50 also aid in retaining return force generating member in place within handle 12. Other configurations may also be employed to aid in retaining return force generating member in place within handle 12.

The return force generating member 50 may also be integral with the elastomer 17 of the grip portion 14.

The grip portion 14 comprises a longitudinal centerline 70. The bore 40 in the grip portion 14 may be positioned at an angle α with respect to the grip portion longitudinal centerline 70. The angle α may be from about 5° to about 30° . Alternatively, the bore 40 in the grip portion 14 may be aligned with the grip portion longitudinal centerline 70 (not shown).

FIGS. 4-11 are perspective views of alternative return force generating members of the present invention. Each return force generating member 150 comprises a holding structure 151, an elastic member 152 and outer support 153 which supports the elastic member 152. The basic functions of each return force generating member 150 and its elements 151-153 are common and similar to those of the return force generating member 50 shown in FIG. 3.

Figure 12:
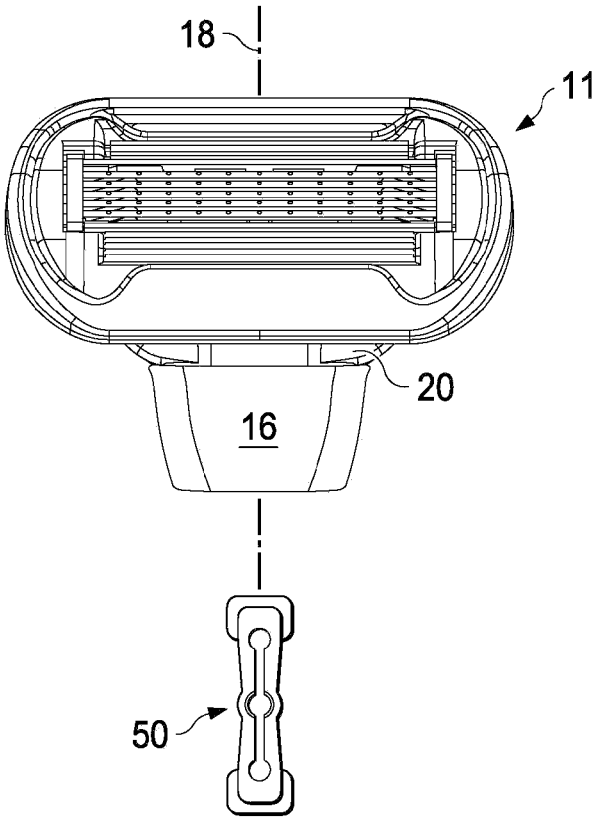
FIGS. 12 and 13 are schematic drawings which depict the function of the return force generating member shown in FIG. 3.
Figure 13:
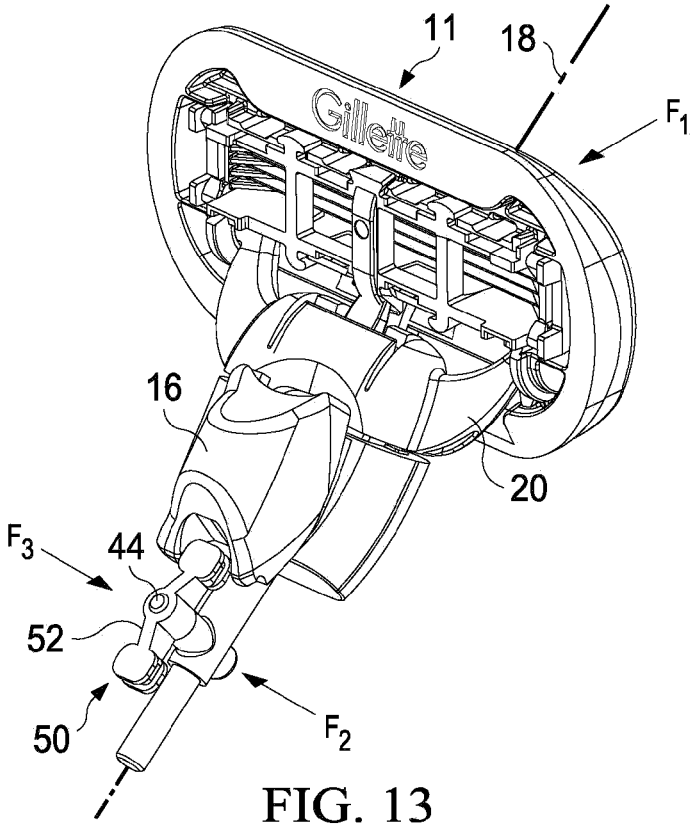

FIGS. 12 and 13 are schematic drawings illustrating the function of the return force generating member 50 shown in FIG. 3. These figures illustrate the relative movements between the connection portion 16, connection member 20 and blade unit 11 which all move in concert together and the return force generating member 50 when the connection portion 16 rotates about rotational axis 18 for following the contours of the body during shaving.

In FIG. 12, as no force is being applied to the blade unit 11, the blade unit 11 is in the rest position. In this state, the blade unit 11 is ready for being biased by a return force generated by the return force generating member 50 if the connection portion 16 rotates about the rotational axis 18.

In FIG. 13, after shaving starts, the blade unit 11 receives a force F1 which is applied from the skin causing the blade unit 11 to rotate about rotational axis 18. Connection portion 16 and connection member 20 each rotate with blade unit 11 in response to force F1. In response to this, pin 44 pushes the elastic members 52 with a force F2. In response to force F2, a return force F3 is generated by the elastic member 52. The return force F3 is transmitted via the pin 44 to the rod 42 (not shown in FIG. 13) thereby rotating the connection portion 16 and accordingly blade unit 11 back to the rest position. Similarly, the return force generating member 50 work when an opposite force to the force F1 is applied to the blade unit 11 from the skin during shaving.

The return force generated by the return force generating member 50 can be either linear or non-linear acting to return the connection portion 16 back to the rest position. The torque range can be from about 0 Nmm to about 15 Nmm as the connection portion 16 rotates from a rest position about the rotation axis 18 in either direction. Other torque ranges both larger and small may be used as desired. The torque can be varied depending on the elastic property of the return force generating member used.

As the safety razor allows the blade unit to pivot about pivot axis and the connection portion to rotate about the rotation axis the blade unit can optimally conform to the contours of the body during shaving.

Figure 14:
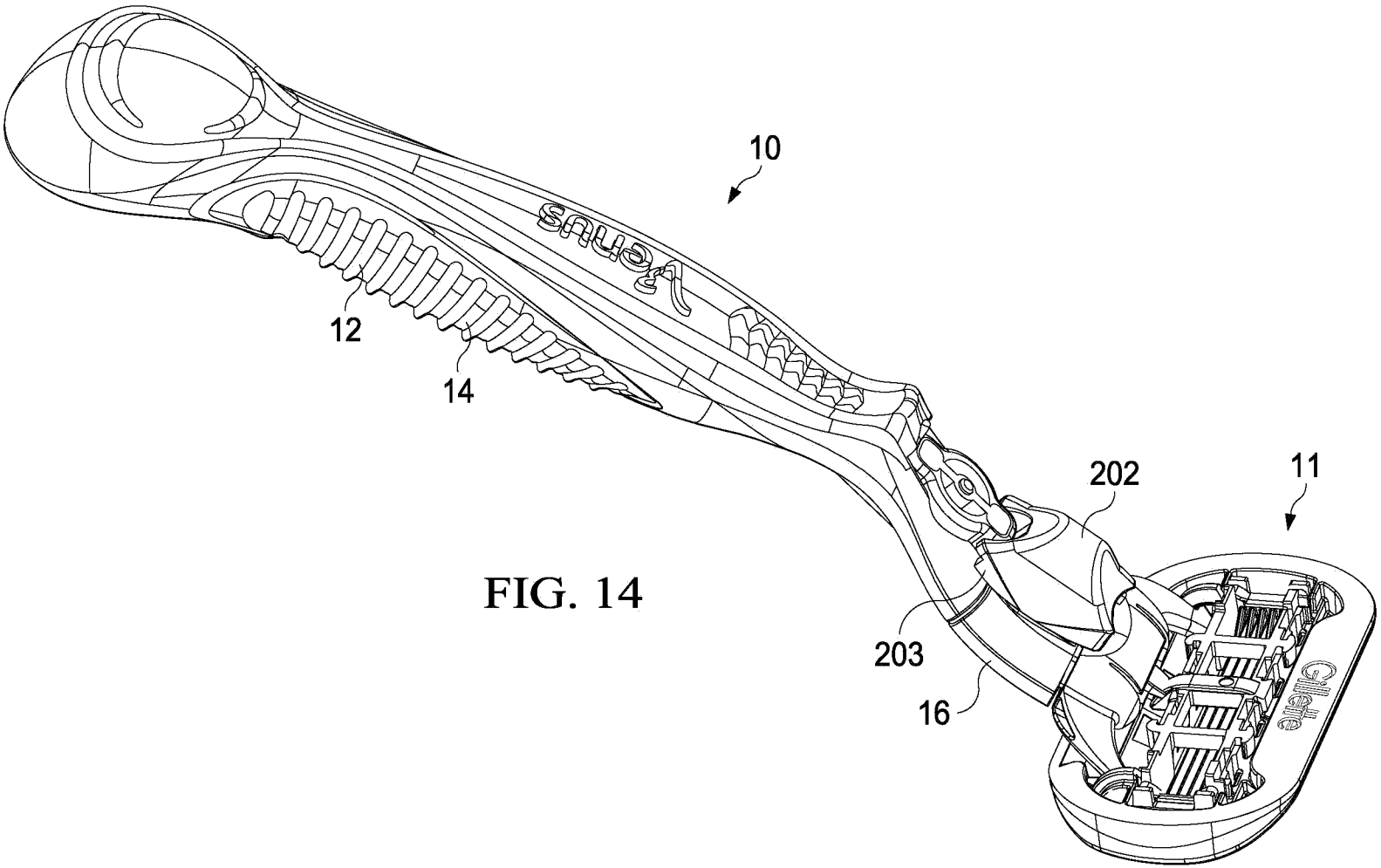
FIG. 14 is a top side view of the safety razor of FIG. 1 with the ejector button in the first position.

Referring now to FIG. 14, safety razor 10 has an ejector button 202 positioned on connection portion 16. The ejector button 202 is shown in FIG. 14 in a first position. In the first position the ejector button 202 locks the connection portion 16 in place with respect to the grip portion 14 of handle 12. While in the first position the ejector button 202 prevents the connection portion 16 from rotating with respect to the grip portion 14. While in the first position a rear portion 203 of ejector button 202 extends beyond connection portion 16 and is positioned on grip portion 14. When positioned over grip portion 14 rear portion 203 of ejector button 202 prevents connection portion 16 from rotating with respect to grip portion 14. Other techniques may be used for preventing rotational movement of connection portion 16 with respect to grip portion 14 while the ejector button 202 is in the first position. Blade unit 11 is attached to connection portion 16 while the ejector button is in the first position.

Figure 15:
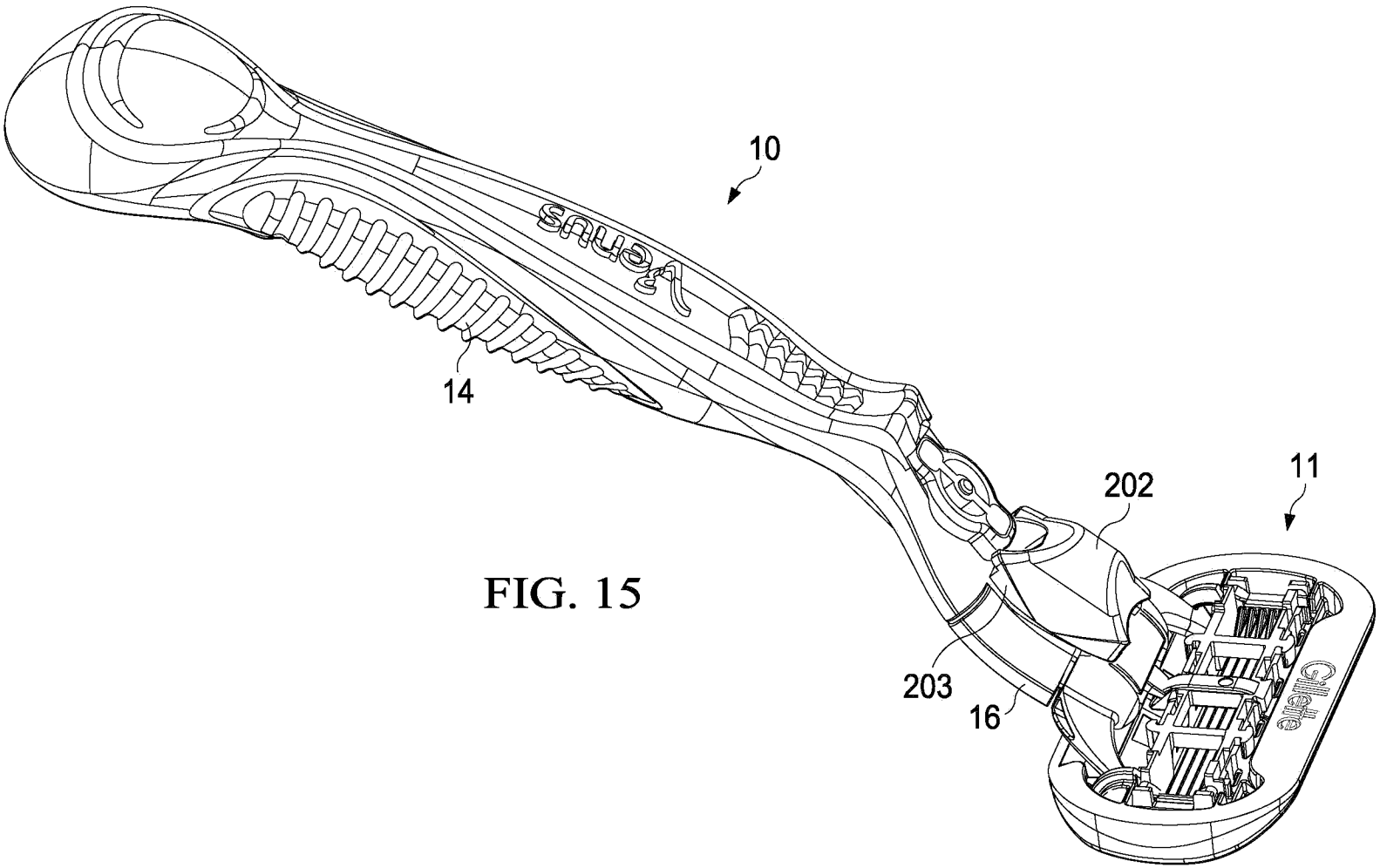
FIG. 15 is a top side view of the safety razor of FIG. 1 with the ejector button in the second position.

Referring now to FIG. 15, ejector button 202 is shown in a second position. In the second position the connection portion 16 is allowed to freely rotate with respect to the grip portion 14. In the second position the rear portion 203 of ejector button 202 does not extend beyond the connection portion 16 and is not positioned on the grip portion 14. Blade unit 11 is attached to connection portion 16 while the ejector button is in the second position.

Figure 16:
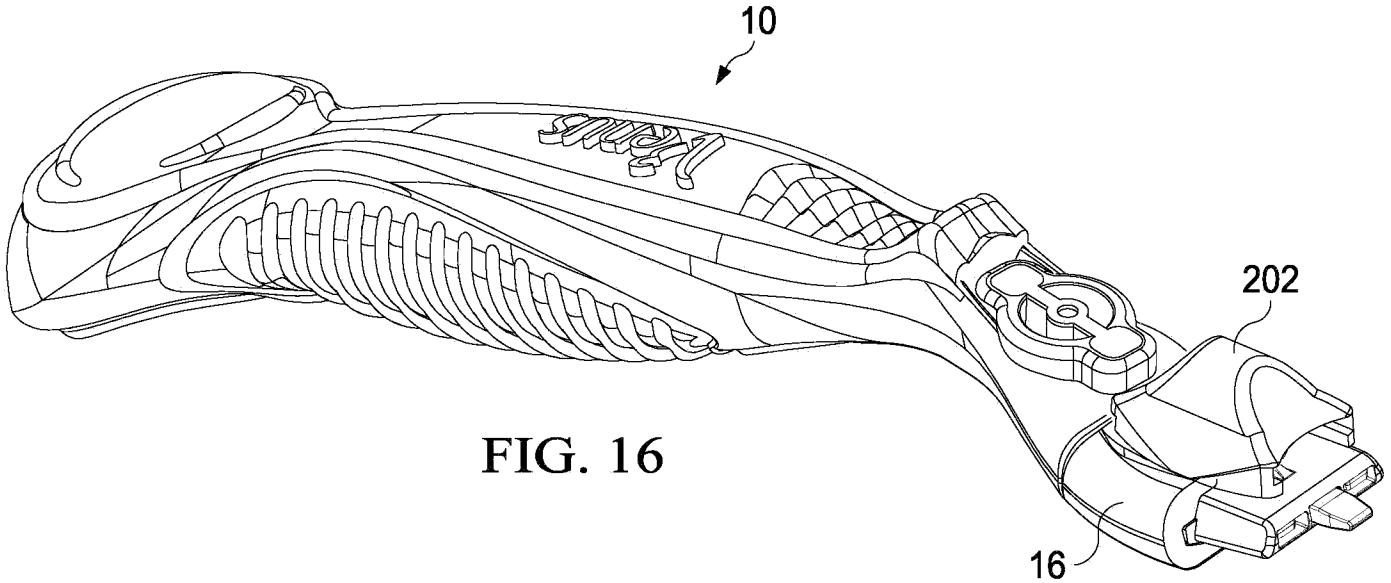
FIG. 16 is a top side view of the safety razor of FIG. 1 with the ejector button in the third position.

Referring now to FIG. 16, ejector button 202 is shown in a third position. In the third position the blade unit (not shown) is ejected from the connection portion 16. There are numerous techniques for securing the blade unit to and ejecting a blade unit from a handle which may be used with the present invention.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A safety razor comprising;

a handle comprising a grip portion and a connection portion secured to the grip portion, the connection portion rotating with respect to the grip portion about a rotational axis;

a blade unit being mounted to the connection portion by a connection member; and an ejector button positioned on the handle, the ejector button having a first position locking the connection portion with respect to the grip portion preventing the connection portion from rotating with respect to the grip portion, a second position allowing the connection portion to rotate with respect to the grip portion, and a third position for ejecting the blade unit from the connection portion.

2. The safety razor according to claim 1, wherein the blade unit comprises a guard, a cap, at least one blade positioned between the guard and the cap and a transverse centerline extending through the guard and the cap in a direction substantially perpendicular to the at least one blade, the blade unit pivoting with respect to the connection member about a pivot axis substantially parallel to the at least one blade.

3. The safety razor according to claim 1, wherein the rotational axis intersects the transverse centerline.

4. The safety razor according to claim 1, wherein the grip portion comprises a bore and the connection portion comprises a rod, the bore of the grip portion receiving the rod of the connection portion.

5. The safety razor according to claim 4, wherein the rod comprises a pin extending radially outward from the rod.

6. The safety razor according to claim 5, further comprising a return force generating member connecting the pin with the grip portion.

7. The safety razor according to claim 6, wherein the return force generating member comprises an elastomeric member.

8. The safety razor according to claim 4, wherein the grip portion comprises a longitudinal centerline, the bore being positioned at an angle with respect to the grip portion longitudinal centerline.

9. The safety razor according to claim 1, wherein the blade unit is releasably mounted to the connection portion by the connection member.

10. A safety razor comprising;

a handle comprising a grip portion and a connection portion secured to the grip portion, the connection portion rotating with respect to the grip portion about a rotational axis;

a blade unit being mounted to the connection portion by a connection member, the blade unit comprising a guard, a cap, at least one blade positioned between the guard and the cap and a transverse centerline extending through the guard and the cap in a direction substantially perpendicular to the at least one blade, the blade unit pivoting with respect to the connection member about a pivot axis substantially parallel to the at least one blade; and an ejector button positioned on the handle, said ejector button having a first position locking the connection portion with respect to the grip portion preventing the connection portion from rotating with respect to the grip portion, a second position allowing the connection portion to rotate with respect to the grip portion, and a third position for ejecting the blade unit from the connection portion.

11. The safety razor according to claim 10, wherein the rotational axis intersects the transverse centerline.

12. The safety razor according to claim 10, wherein the grip portion comprises a bore and the connection portion comprises a rod, the bore of the grip portion receiving the rod of the connection portion.

13. The safety razor according to claim 12, wherein the rod comprises a pin extending radially outward from the rod.

14. The safety razor according to claim 13, further comprising a return force generating member connecting the pin with the grip portion.

15. The safety razor according to claim 14, wherein the return force generating member comprises an elastomeric member.

16. The safety razor according to claim 12, wherein the grip portion comprises a longitudinal centerline, the bore being positioned at an angle with respect to the grip portion longitudinal centerline.

17. The safety razor according to claim 10, wherein the blade unit is releasably mounted to the connection portion by the connection member.

* * * * *